US009787001B2

(12) United States Patent
Nakayama

(10) Patent No.: US 9,787,001 B2
(45) Date of Patent: Oct. 10, 2017

(54) TERMINAL FITTING AND WIRE WITH TERMINAL FITTING

(71) Applicant: Sumitomo Wiring Systems, Ltd., Yokkaichi, Mie (JP)

(72) Inventor: Yasuaki Nakayama, Yokkaichi (JP)

(73) Assignee: SUMITOMO WIRING SYSTEMS, LTD., Yokkaichi, Mie (JP)

( * ) Notice: Subject to any disclaimer, the term of this patent is extended or adjusted under 35 U.S.C. 154(b) by 154 days.

(21) Appl. No.: 14/621,541

(22) Filed: Feb. 13, 2015

(65) Prior Publication Data

US 2015/0229035 A1 Aug. 13, 2015

(30) Foreign Application Priority Data

Feb. 13, 2014 (JP) ..... 2014-025465

(51) Int. Cl.

| | |
|---|---|
| ***H01R 9/05*** | (2006.01) |
| ***H01R 4/02*** | (2006.01) |
| *H01R 13/11* | (2006.01) |
| *H01R 43/02* | (2006.01) |
| *H01R 4/18* | (2006.01) |
| *H01R 11/12* | (2006.01) |

(52) U.S. Cl.

CPC ..... *H01R 4/024* (2013.01); *H01R 4/185* (2013.01); *H01R 4/187* (2013.01); *H01R 11/12* (2013.01); *H01R 13/114* (2013.01); *H01R 43/0263* (2013.01)

(58) Field of Classification Search

CPC .... H02G 15/043; H02G 15/003; H01R 4/021; H01R 4/22; H01R 4/23; H01R 4/023; H01R 13/512; H01R 13/59

USPC ... 174/74 R, 76, 77 R, 84 R, 84 C, 84 S, 86, 174/87, 94 R

See application file for complete search history.

(56) References Cited

U.S. PATENT DOCUMENTS

| | | | | | |
|---|---|---|---|---|---|
| 3,744,128 | A * | 7/1973 | Fisher | H01R 13/6599 | 174/75 C |
| 4,995,838 | A * | 2/1991 | Ayer | H01R 4/723 | 174/84 R |
| 5,281,760 | A * | 1/1994 | Kikuchi | H01R 11/28 | 174/74 R |
| 5,418,331 | A * | 5/1995 | Delalle | H01R 4/22 | 174/74 R |
| 5,725,400 | A * | 3/1998 | Morikawa | B23K 1/0016 | 174/74 R |
| 2007/0095555 | A1 * | 5/2007 | Venaleck | H01R 9/0518 | 174/75 C |

(Continued)

FOREIGN PATENT DOCUMENTS

| | | | | |
|---|---|---|---|---|
| JP | 2010-123449 A * | 6/2010 | ..... | H01R 4/18 |
| JP | 2010-146939 | 7/2010 | | |
| WO | 2013133409 | 9/2013 | | |

*Primary Examiner* — William H Mayo, III

(74) *Attorney, Agent, or Firm* — Gerald E. Hespos; Michael J. Porco; Matthew T. Hespos

(57) ABSTRACT

A terminal fitting includes a soldering portion (11) to which a conductor (91) of a wire (90) is to be soldered, solid solder (60) for soldering the conductor (91) to the soldering portion (11) in a solid state, and a holding portion (20) that holds the solid solder (60) until the solid solder (60) is melted and the conductor (91) is soldered. The conductor (91) is connected to the soldering portion (11) by melting the solid solder (60) held in the holding portion (20).

15 Claims, 17 Drawing Sheets

(56) References Cited

U.S. PATENT DOCUMENTS

| | | | | |
|---|---|---|---|---|
| 2013/0008714 | A1* | 1/2013 | Morikawa | H01R 4/20 174/74 R |
| 2014/0202751 | A1* | 7/2014 | Bugg | H01R 9/032 174/261 |
| 2015/0229090 | A1* | 8/2015 | Hasagawa | H01R 43/0484 174/74 R |

* cited by examiner

TERMINAL FITTING AND WIRE WITH TERMINAL FITTING

BACKGROUND

1. Field of the Invention

The present invention relates to a terminal fitting and a wire with a terminal fitting.

2. Description of the Related Art

Japanese Unexamined Patent Publication No. 2010-146939 discloses a structure for soldering and connecting a coaxial center conductor to a terminal. Paste solder is attached to the center core in advance. The center core is placed on a terminal arrangement surface of the terminal together with the attached paste solder and, in that state, the paste solder is melted to connect the center core to the terminal.

In the above case, it is difficult to attach a predetermined amount of solder to the center core. Thus, the supply amount of solder may vary for each terminal, which is not favorable in terms of quality stability.

The present invention was completed based on the above situation and aims to easily and properly control the supply amount of solder.

SUMMARY

A terminal fitting according to the invention has a soldering portion to which a conductor of a wire is to be soldered, solid solder for soldering the conductor to the soldering portion in a solid state and a holding portion that holds the solid solder until the solid solder is melted and the conductor is soldered.

The holding portion may include at least one holding piece that comes into contact with the solid solder in a direction intersecting an extending direction of the wire.

The holding piece may have a step serving as a reference in positioning the conductor between the holding piece and an outer surface of the solid solder. The step avoids the need to provide a special positioning means and the configuration can be simplified.

The holding piece may be tapered toward its projecting end to have a smaller width in the front-back direction.

Plural holding pieces may be provided and may have parts to be overlapped in the width direction.

The holding portion may crimp and hold the solid solder so that the solid solder is fixed stably and firmly to the holding portion.

The holding portion may resiliently hold the solid solder. Thus, a special mounting apparatus is not necessary to mount the solid solder into the holding portion and the solid solder can be mounted easily.

The terminal fitting may comprises a terminal connection portion to be connected to a mating terminal fitting. The soldering portion may be wider than a bottom plate of the terminal connecting portion by having a coupling arranged between the terminal connecting portion and the soldering portion.

The soldering portion may comprise a curved solder attaching surface, provided to enclose at least part of the conductor of the wire and to which solder is attached by heating and melting the solid solder.

The invention also relates to a wire with a terminal fitting of the present invention is a wire connected to a terminal fitting including a soldering portion and at least one holding portion for holding solid solder, and the solid solder is melted and a conductor of the wire is soldered to the soldering portion.

The conductor is connected to the soldering portion by melting the solid solder held in or at the holding portion. Thus, the terminal fitting is supplied in a state where the solder is held in the form of the solid solder in the holding portion, handling is excellent. In addition, since the supply amount of solder used for the connection of the terminal fitting and the conductor can be specified in advance as the solid solder, the supply amount of solder can be easily and properly controlled.

These and other objects, features and advantages of the invention will become more apparent upon reading the following detailed description of preferred embodiments and accompanying drawings. It should be understood that even though embodiments are separately described, single features thereof may be combined to additional embodiments.

DETAILED DESCRIPTION

Figure 1:
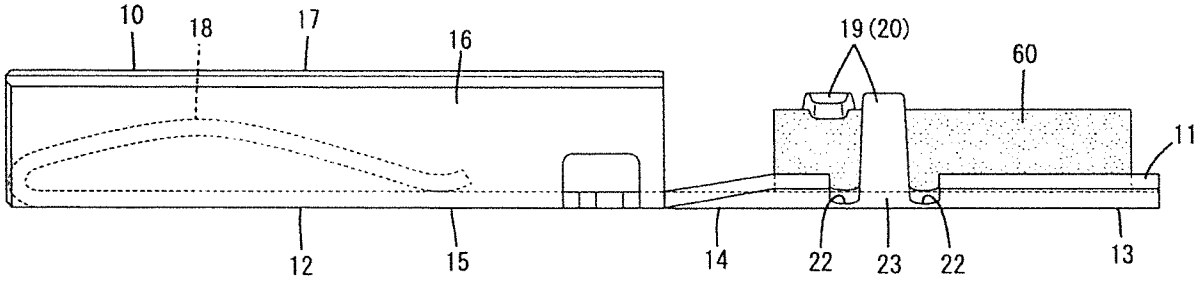
FIG. 1 is a side view of a terminal fitting of a first embodiment.

A first embodiment of the invention is described with reference to FIGS. 1 to 6. A terminal fitting of the first embodiment includes solid solder 60 and a terminal main body 10. The solid solder 60 functions to connect and fix a conductor 91 of a wire 90 to a later-described soldering portion 11 of a terminal main body 10 by being heated and melted.

Figure 3:
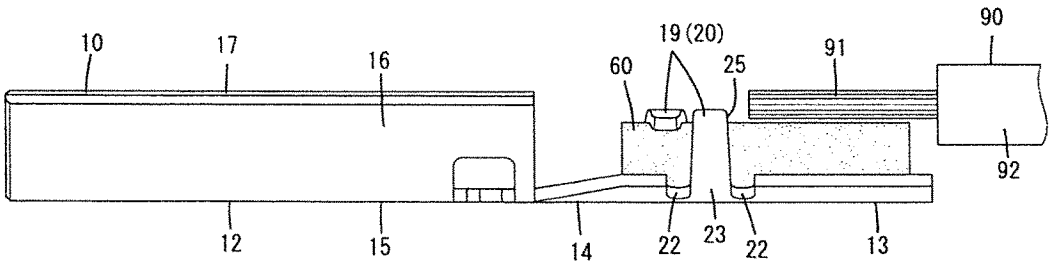
FIG. 3 is a side view showing a state where a conductor of a wire is placed on the upper end of solid solder of the terminal fitting.

As shown in FIG. 3, the wire 90 to be connected to the terminal fitting is an insulated wire comprising the conductor 91 made of a core wire or the like and an insulating coating 92 surrounding the conductor 91. The wire 90 may be a coaxial cable or an ordinary wire. The coating 92 is removed to expose the conductor 91 at a front end part of the wire 90.

Figure 2:
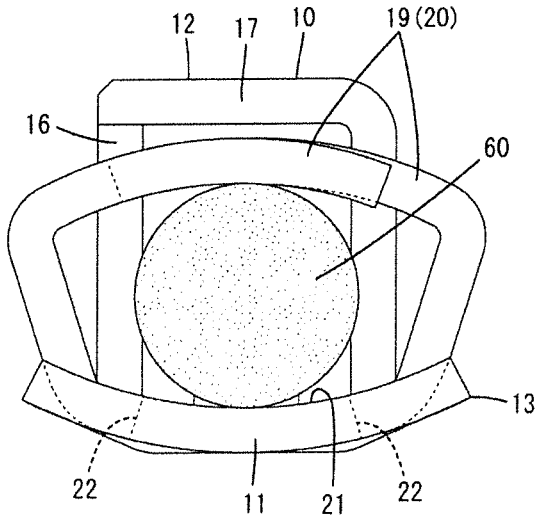
FIG. 2 is a rear view of the terminal fitting of the first embodiment.

A substantially cylindrical lead thread solder 60 (e.g. a lead-free tin solder) is shown in FIGS. 1 and 2 and is long and narrow in a front-back direction. The amount of the solid solder 60 is a specified amount capable of soldering the conductor 91 to the soldering portion 11 when the solid solder 60 is melted. Further, a length of the solid solder 60 in the front-back direction is set within a length of the later-described soldering portion 11 in the front-back direction.

The terminal main body 10 is formed unitarily by folding, embossing and/or bending an electrically conductive metal plate (e.g. made of copper or copper alloy) and is long and narrow in the front-back direction. Specifically, the terminal main body 10 includes a terminal connecting portion 12 on a front part, a wire connecting portion 13 on a rear part and a coupling 14 extending between and coupling the wire connecting portion 13 and the terminal connecting portion 12.

Figure 6:
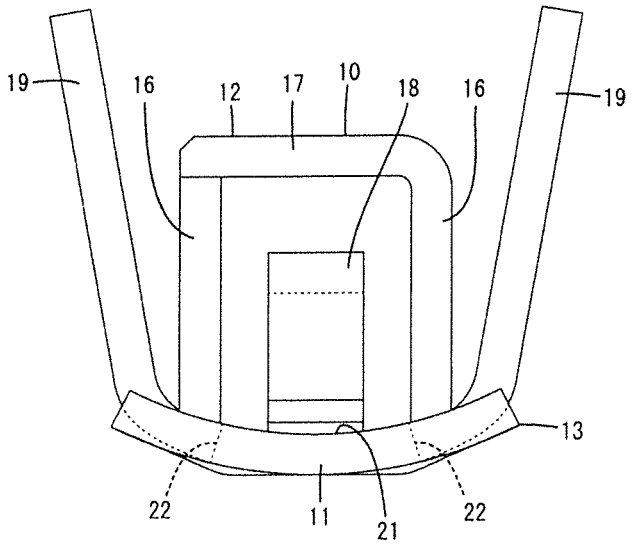
FIG. 6 is a rear view of the terminal main body before the solid solder is held.

As shown in FIGS. 1 and 6, the terminal connecting portion 12 is a substantially rectangular tube that is long and narrow in the front-back direction and includes a bottom plate 15, two side plates 16 standing from opposite sides of the bottom plate 15 and a ceiling plate 17 extending from the upper end of one of the side plates 16 toward the upper end of the other. The ceiling plate 17 is arranged to face the bottom plate 15 substantially in parallel.

A resilient contact piece 18 is provided in the terminal connecting portion 12, as shown in FIG. 1. The resilient contact piece 18 is bent to have a chevron shape by folding back a part extending forward from the front end of the bottom plate 15 in a development state. A tab of an unillustrated mating terminal fitting can be inserted into the terminal connecting portion 12 and resiliently contacts the resilient contact piece 18 for electrically connecting the two terminal fittings.

Figure 5:
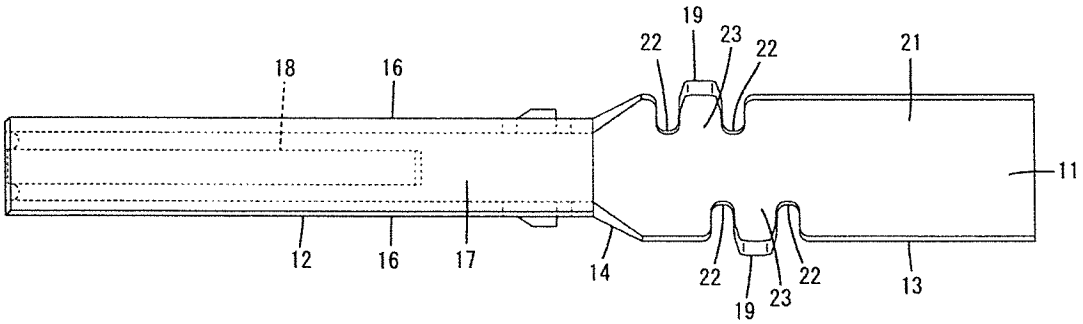
FIG. 5 is a plan view of a terminal main body before the solid solder is held.

The wire connecting portion 13 includes the soldering portion 11 in the form of a strip extending long and narrow in the front-back direction and having a curved arcuate cross-sectional shape, as shown in FIGS. 5 and 6. Two holding pieces 19 project from opposite side edges of a front end part of the soldering portion 11. As shown in FIG. 1, the holding pieces 19 form a holding portion 20.

Further, as shown in FIG. 5, the front end of the coupling 14 is connected unitarily to the rear end of the bottom plate 15 in the terminal connecting portion 12 and the rear end thereof is connected unitarily to the front end of the soldering portion 11. The coupling 14 extends a short distance in the front-back direction as compared to the extension length of the soldering portion 11. The coupling 14 gradually widens from the front end to the rear end and gradually curves toward the front end of the soldering portion 11.

The soldering portion 11 is wider than the bottom plate 15 of the terminal connecting portion 12 by having the coupling 14 between the wire connecting portion 12 and the soldering portion 11, as shown in FIG. 5. The upper surface of the soldering portion 11 defines a curved solder attaching surface 21 that encloses the conductor 91 of the wire 90 and to which the solder is attached, by heating and melting the solid solder 60.

Further, as shown in FIG. 5, front and rear U-shaped slits 22 are provided at positions displaced in the front-back direction on each of the opposite side edges of the front end part of the soldering portion 11.

Each of the holding pieces 19 has a base end portion 23 connected to the soldering portion 11 between the front and rear slits 22. The holding pieces 19 are strips that project from the base ends 23 in directions perpendicular to the front-back direction. Specifically, the holding pieces 19 are tapered toward their projecting ends to have a smaller width in the front-back direction and are displaced from each other in the front-back direction. The holding pieces 19 function to crimp and hold the solid solder 60 as described later.

The holding pieces 19 are kept in an open state before the solid solder 60 is mounted to the terminal main body 10 and stand up from the opposite side edges of the front end part of the soldering portion 11, as shown in FIGS. 5 and 6.

In the above state, the solid solder 60 is placed on the solder attaching surface 21 of the soldering portion 11 and the solid solder 60 is mounted in the terminal main body 10. At this time, the front end of the solid solder 60 is arranged substantially on the front end of the soldering portion 11 and the rear end thereof is arranged before the rear end of the soldering portion 11.

The holding pieces 19 then are deformed by an unillustrated caulking apparatus (anvil and crimper, etc.) to press an upper end part of the solid solder 60. In this way, as shown in FIG. 1, the solid solder 60 is held tightly between the holding pieces 19 and the soldering portion 11.

Specifically, as shown in FIG. 2, the solid solder 60 is sandwiched between the soldering portion 11 and the holding pieces 19 in a state where a lower end part of the solid solder 60 is held in contact with a widthwise central part of the solder attaching surface 21 of the soldering portion 11 and an upper end part thereof is held in contact with the inner surfaces of the holding pieces 19. Clearances are formed in the width direction between opposite widthwise end parts of the solid solder 60 and intermediate parts of the both holding pieces 19 in a projecting direction. In this case, the holding pieces 19 have parts to be overlapped in the width direction. However, since these parts are displaced in the front-back direction, they are not overlapped in a height direction. The base end portion 23 at which the holding piece 19 starts being deformed is arranged between the front and rear slits 22. Thus, the base end portion 23 does not bulge out significantly from the soldering portion 11 in the width direction.

The terminal fitting shown in FIG. 1 carrying the aforementioned solid solder 60 then is transported to a site of a solder-connecting operation. At this time, the solid solder 60 is held in the terminal main body 10 by the holding pieces 19. Thus, handling is improved drastically as compared with the case where the terminal main body 10 and the solid solder 60 are supplied separately.

Subsequently, as shown in FIG. 3, the conductor 91 exposed at the front part of the wire 90 is placed on the upper end part of the solid solder 60. A radially extending step 25 is formed between the rear end of the rear holding piece 19 and the outer peripheral surface of the solid solder 60. This step 25 serves as a reference for positioning the conductor 91. Specifically, the conductor 91 is set with the front end slightly behind the rear end of the rear holding piece 19.

Figure 4:
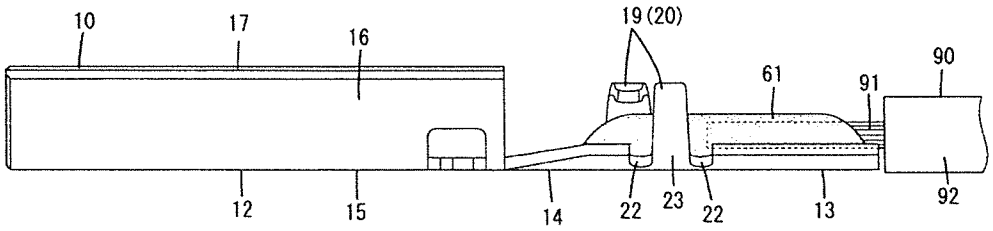
FIG. 4 is a side view showing a state where the solid solder is melted and the conductor of the wire is soldered to a soldering portion.

The solid solder 60 then is heated and melted, as shown in FIG. 4. Thus, the conductor 91 sinks into and is joined to the molten solder 61 and is connected to the soldering portion 11 using a predetermined amount of solder equivalent to the amount of the solid solder 60. Further, melting the solid solder 60 cancels a state of holding the solid solder 60 by the respective holding pieces 19. In this way, the wire 90 with the terminal fitting in which the conductor 91 is soldered and connected to the soldering portion 11 is obtained.

As described above, according to the first embodiment, the supply amount of solder is set to be a predetermined specified amount of the solid solder 60 when soldering the conductor 91 of the wire 90 to the soldering portion 11 of the terminal fitting. Thus, the supply amount of solder does not vary in each terminal fitting to be produced and supply stability and quality stability is improved.

Further, the respective holding pieces 19 are crimped to hold the solid solder 60. Thus, the state where the solid solder 60 is held by the respective holding pieces 19 can be maintained reliably until the solid solder 60 is melted. Furthermore, the step 25 between the rear end of the rear holding piece 19 and the outer peripheral surface of the solid solder 60 is a reference in positioning the conductor 91 of the wire 90, and a special structure is not required for positioning the conductor 91 of the wire 90 so that the configuration is simplified.

FIGS. 7 to 10 show a second embodiment of the invention. The second embodiment differs from the first embodiment in the shape of a holding portion 20A in a terminal main body 10A. The structure of the second embodiment except the holding portion 20A is similar to that of the first embodiment. Thus, components of the second embodiment that are similar to the first embodiment are denoted by the same reference signs and not repeatedly described.

Figure 7:
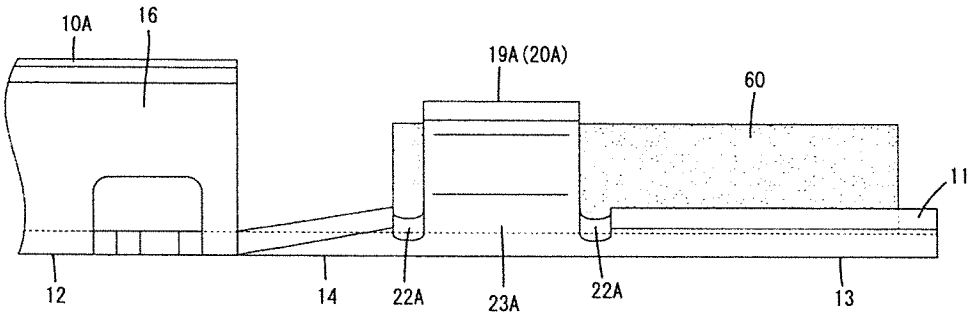
FIG. 7 is an enlarged side view of an essential part of a terminal fitting of a second embodiment.
Figure 10:
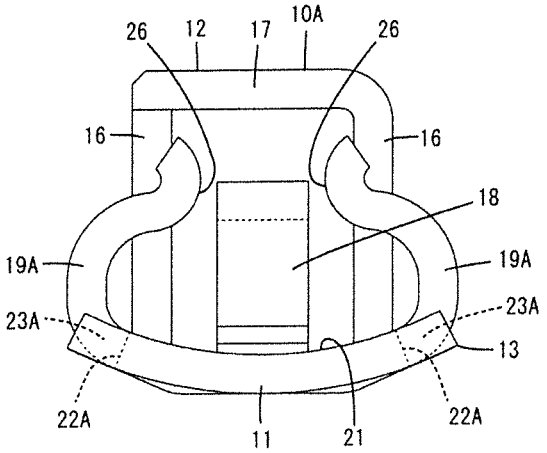
FIG. 10 is a rear view of the terminal main body before the solid solder is held.

The holding portion 20A comprises two deflectable and deformable holding pieces 19A. As shown in FIG. 10, the holding pieces 19A are strips projecting up from opposite sides of a front part of the soldering portion 11. As shown in FIG. 7, a base end 23A of the holding piece 19A is adjacent to and between front and rear slits 22A formed on the side edge of the soldering portion 11 as in the first embodiment.

Figure 9:
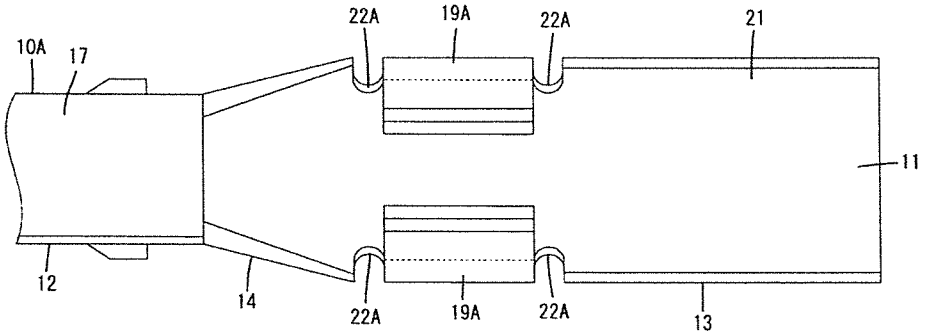
FIG. 9 is an enlarged plan view of an essential part of the terminal fitting before solid solder is held.

Specifically, as shown in FIG. 9, the holding pieces 19A are arranged substantially at the same position in a front-back direction on the opposite side edges of the front end part of the soldering portion 11 and have substantially the same width in the front-back direction over the entire length. More specifically, as shown in FIG. 10, the holding pieces 19A are bent in toward a widthwise central part of the soldering portion 11 and toward each other after standing up from the base end portions 23A and arcuately bend out at inner end portions 26 closest to each other. A separating distance between the inner end portions 26 of the holding pieces 19A (separating distance in a width direction) is shorter than a diameter of solid solder 60.

Figure 8:
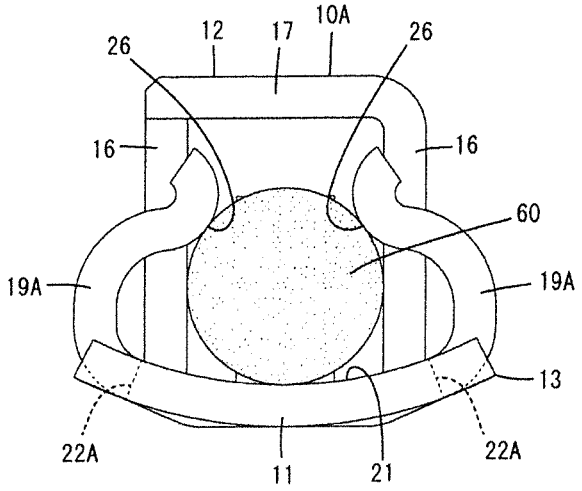
FIG. 8 is a rear view of the terminal fitting of the second embodiment.

In mounting the solid solder 60, the solid solder 60 is pulled down to a solder attaching surface 21 of the soldering portion 11 from above. In the process of lowering the solid solder 60, the solid solder 60 is inserted between the inner ends 26 of the holding pieces 19A and, associated with that, the holding pieces 19A are deflected and deformed out with the base ends 23A as supports. When the lower end of the solid solder 60 reaches a position to contact the solder attaching surface 21, as shown in FIG. 8, the holding pieces 19A are displaced in return directions to press an upper part of the solid solder 60. In this way, the solid solder 60 is held in contact with the inner end portions 26 of the holding pieces 19A and a widthwise central part of the solder attaching surface 21 at three positions.

According to the second embodiment, the solid solder 60 can be mounted easily between the both holding pieces 19A by deflecting the holding pieces 19A from above in one action.

Figure 11:
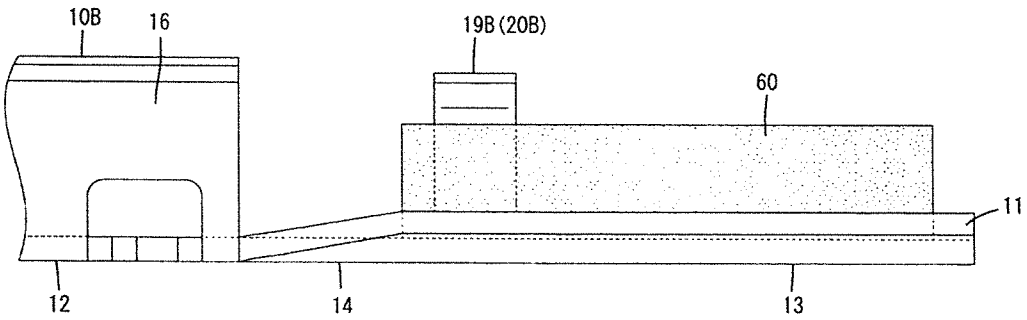
FIG. 11 is an enlarged side view of an essential part of a terminal fitting of a third embodiment.
Figure 12:
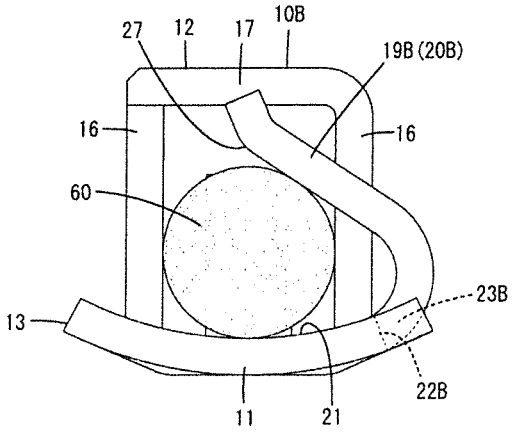
FIG. 12 is a rear view of the terminal fitting of the third embodiment.
Figure 13:
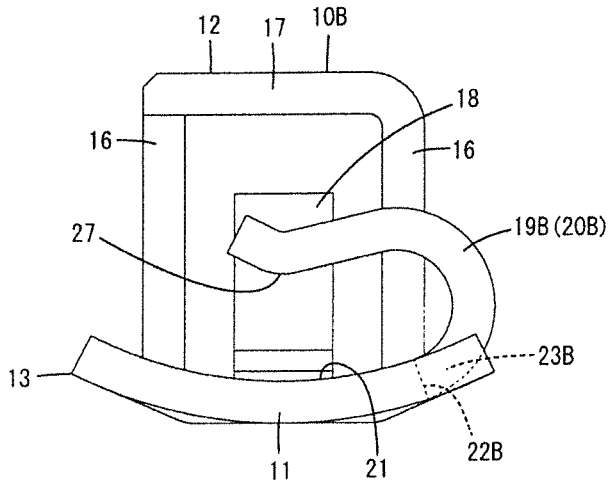
FIG. 13 is a rear view of the terminal main body before solid solder is held.

FIGS. 11 to 13 show a third embodiment of the present invention. The third embodiment is common to the second embodiment in that a holding portion 20B of a terminal main body 10B is deflectable and deformable, but differs from the second embodiment in a specific structure of the holding portion 20B.

The holding portion 20B comprises a single holding piece 19B in the form of a strip projecting up from one side edge of a front end part of a soldering portion 11. Although not shown in detail, a base end portion 23B of the holding piece 19B is arranged between front and rear slits 22B formed on the one side of the soldering portion 11 (see FIG. 13).

Specifically, as shown in FIGS. 11 and 13, the holding piece 19B has substantially the same width in a front-back direction over the entire length and is bent arcuately in after standing up from the base end portion 23B and a tip portion 27 in an extending direction is bent up. In this case, the tip of the holding piece 19B in the extending direction reaches a position close to the other side of the soldering portion 11 beyond a widthwise central part of the soldering portion 11. In short, the holding piece 19B has a substantially U shape open toward the other widthwise side. A separating distance between the tip 27 of the holding piece 19B in the extending direction and a solder attaching surface 21 of the soldering portion 11 (separating distance in a height direction) is smaller than a diameter of solid solder 60.

The solid solder 60 is inserted laterally between the holding piece 19B and the soldering portion 11. Thus, the solid solder 60 contacts the tip 27 of the holding piece 19B in the extending direction while sliding on the solder attaching surface 21. Additionally, the holding piece 19B is deflected and deformed up with the base end 23B as a supporting. When the lower end of the solid solder 60 reaches the widthwise central part of the solder attaching surface 21 of the soldering portion 11 as shown in FIG. 12, any further mounting operation of the solid solder 60 is restricted and the holding piece 19B resiliently presses the upper part of the solid solder 60. In this way, the solid solder 60 is held in contact with the holding piece 19B and the widthwise central part of the solder attaching surface 21 of the soldering portion 11 at two positions.

According to the third embodiment, associated with the deflection of the holding piece 19B, the solid solder 60 can be mounted easily laterally between the holding piece 19B and the soldering portion 11 in one action. Further, according to the third embodiment, the entire configuration can be further simplified since the holding portion 20B is the single holding piece 19B.

FIGS. 14 to 17 show a fourth embodiment of the invention. The fourth embodiment is common to the second and third embodiments in that a holding portion 20C of a terminal main body 10C is deflectable and deformable, but differs from the second and third embodiments in a specific structure of the holding portion 20C.

Figure 14:
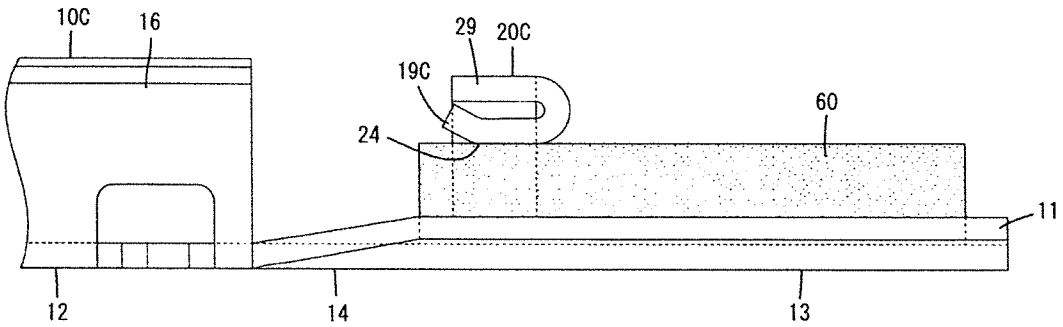
FIG. 14 is an enlarged side view of an essential part of a terminal fitting of a fourth embodiment.
Figure 16:
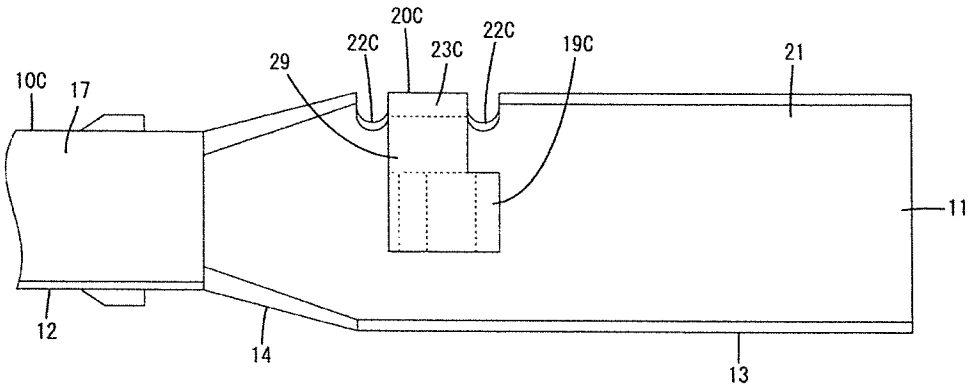
FIG. 16 is an enlarged plan view of an essential part of the terminal main body before solid solder is held.
Figure 17:
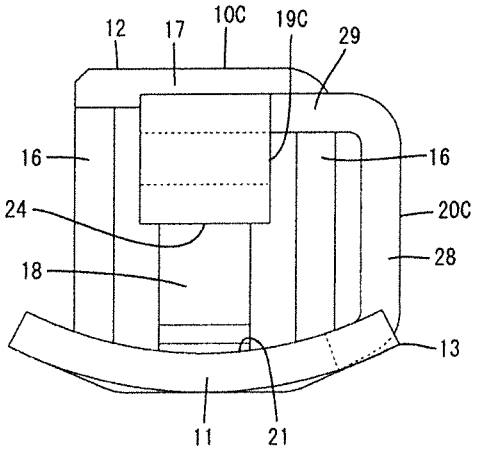
FIG. 17 is a rear view of the terminal main body before the solid solder is held.

The holding portion 20C is formed by bending a plate piece of a metal plate and includes, as shown in FIGS. 14 and 17, a leg 28 standing up from one side edge of a soldering portion 11, a beam 29 bent in substantially perpendicularly from the upper end of the leg 28 and a holding piece 19C folded into a U shape from the rear end of a tip side of the beam 29 in an extending direction and having a tip bent slightly up. As shown in FIG. 16, a base end 23C of the leg 28 is arranged between front and rear slits 22C formed on the one side edge of the soldering portion 11. The holding piece 19C is arranged at a position corresponding to a widthwise central part of the soldering portion 11 and has a substantially U shape open backward. A separating distance between a folded tip 24 of the holding piece 19C and a solder attaching surface 21 of the soldering portion 11 (separating distance in a height direction) is smaller than a diameter of solid solder 60.

Figure 15:
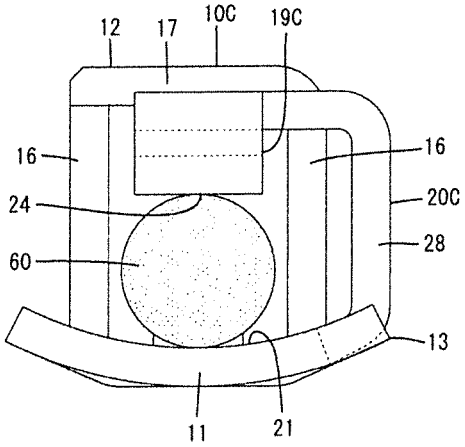
FIG. 15 is a rear view of the terminal fitting of the fourth embodiment.

The solid solder 60 is inserted into between the holding piece 19C and the soldering portion 11 from behind. Thus, the solid solder 60 slides on the outer surface of the folded part of the holding piece 19C along the solder attaching surface 21 and, hence, the holding piece 19C is deflected and deformed up with a coupled part to the beam 29 as a supporting. The solid solder 60 moves forward until the front end thereof reaches a position corresponding to the front end of the soldering portion 11, as shown in FIG. 14. The solid solder 60 then is sandwiched resiliently between a widthwise central part of the folded tip 24 of the holding piece 19C and a widthwise central part of the solder attaching surface 21 of the soldering portion 11, as shown in FIG. 15.

According to the fourth embodiment, associated with the deflection of the holding piece 19C, the solid solder 60 can be mounted easily between the holding piece 19C and the soldering portion 11 from behind in one action.

The invention is not limited to the above described embodiments. For example, the following modes also are included in the scope of the invention.

The solid solder may be plate solder in the form of a strip long in the front-back direction. According to this, the conductor of the wire can be placed on a flat plate surface of the plate solder, whereby support stability at the time of setting the conductor is excellent.

In the first embodiment, the both holding pieces may be arranged at the same position in the front-back direction. In this case, the both holding pieces may be fixed to the solid solder in such a manner as to be placed one over the other in the height direction.

In the first embodiment, the holding pieces may be deformed to be wound around the outer peripheral surface of the solid solder.

The solid solder may be held in the holding portion while being lifted from the upper surface (solder attaching surface) of the soldering portion and the conductor of the wire may be inserted into between the solid solder and the soldering portion.

REFERENCE SIGNS

10, 10A, 10B, 10C . . . terminal main body
11 . . . soldering portion
12 . . . terminal connecting portion
19, 19A, 19B, 19C . . . holding piece
20, 20A, 20B, 20C . . . holding portion
25 . . . step
60 . . . solid solder
90 . . . wire
91 . . . conductor

What is claimed is:

1. A terminal fitting, comprising:

a bottom plate extending in forward and backward directions;

a terminal connecting portion formed on a forward end of the bottom plate and to be connected to a mating terminal fitting;

a wire connecting portion formed on the bottom plate rearward of the terminal connecting portion and coupled to the terminal connecting portion by a coupling;

solid solder extending along the bottom plate from the wire connecting portion to a position forward of the wire connecting portion;

at least one holding portion including at least one holding piece projecting from a side edge of the bottom plate at a position forward of the wire connecting portion and aligned with areas of the solid solder forward of the wire connecting portion, the at least one holding piece being crimped to hold the solid solder on the bottom plate, wherein a conductor of a wire can be placed on the solid solder at a position so that a front end of the conductor is rearward of the holding piece and can be soldered to the solder on the wire connecting portion.

2. The terminal fitting of claim 1, wherein the at least one holding piece comes into contact with the solid solder in a direction intersecting an extending direction of the wire.

3. The terminal fitting of claim 2, wherein the at least one holding piece defines a step that limits a maximum forward positioning of the conductor on the solid solder.

4. The terminal fitting of claim 2, wherein the at least one holding piece is tapered toward its projecting end to have a smaller width in a front-back direction.

5. The terminal fitting of claim 2, wherein the at least one holding piece comprises plural holding pieces having parts to be overlapped in a width direction.

6. The terminal fitting of claim 1, wherein the holding portion resiliently holds the solid solder.

7. The terminal fitting of claim 1, wherein the soldering portion is wider than the bottom plate.

8. The terminal fitting of claim 1, wherein the bottom plate comprises a curved solder attaching surface that at least partly encloses the solid solder.

9. A terminated wire assembly, comprising:

a terminal fitting having opposite front and rear ends, a bottom plate extending from the rear end toward the front end, a wire connecting portion formed on the bottom plate adjacent to the rear end and a holding portion forward of the wire connecting portion;

a solid solder extending from the wire connecting portion to the holding portion and being fixed on the terminal fitting by a crimping of the holding portion; and a wire with a conductor positioned on the solid solder at a position rearward of the holding portion, wherein:

the solid solder is melted so that the conductor of the wire is soldered to the soldering portion.

10. The terminated wire of claim 9, wherein the holding portion comes into contact with the solid solder in a direction intersecting an extending direction of the wire.

11. The terminated wire of claim 10, wherein the holding portion has at least one holding piece that defines a step that limits a maximum forward positioning the conductor on the solid solder.

12. The terminated wire of claim 11, wherein the at least one holding piece is tapered toward its projecting end to have a smaller width in a front-back direction.

13. The terminated wire of claim 11, wherein the at least one holding piece comprises plural holding pieces having parts to be overlapped in the width direction.

14. The terminated wire of claim 9, wherein the holding portion resiliently holds the solid solder.

15. The terminate wire of claim 9, wherein the solid solder is wider than the bottom plate.

* * * * *